US005747718A

United States Patent [19]

Bill et al.

[11] Patent Number: 5,747,718

[45] Date of Patent: May 5, 1998

[54] APPARATUS AND METHOD FOR LOADING ITEMS INTO COMPONENT HOLDER

[75] Inventors: Eugene F. Bill, Oroville; Fred B. Blodgett, Chico; Jerry D. Brand, Oroville; Steven J. Koch, Oroville; Lester V. Rodriques, Oroville; Alan D. Schufeldt, Oroville; Steven R. Shields, Oroville; Ronald L. Smith, Oroville, all of Calif.

[73] Assignee: Blount, Inc., Montgomery, Ala.

[21] Appl. No.: 599,962

[22] Filed: Feb. 14, 1996

[51] Int. Cl.[6] ..... F42B 33/00

[52] U.S. Cl. ..... 86/23; 86/1.1; 86/24; 86/45; 53/399; 53/591; 29/525; 29/790; 29/811.2; 29/821

[58] Field of Search ..... 86/1.1, 10, 23, 86/24, 36–38, 44–48; 42/87, 88; 89/35.01; 102/281; 206/3; 53/399, 591; 29/464, 525, 790, 811.2, 821

[56] References Cited

U.S. PATENT DOCUMENTS

| | | | |
|---|---|---|---|
| 1,180,950 | 4/1916 | Sonnberg | 86/48 |
| 1,456,154 | 5/1923 | Shaw | 86/48 |
| 1,468,870 | 9/1923 | Rockwell | 86/48 |
| 1,876,217 | 9/1932 | French | 86/48 |
| 2,344,443 | 3/1944 | McCord et al. | 86/48 |
| 2,387,661 | 10/1945 | Holcomb et al. | 86/23 |
| 2,387,672 | 10/1945 | Mayberry | 86/23 |
| 2,510,555 | 6/1950 | Christie | 86/23 |
| 3,240,103 | 3/1966 | LaMont | 86/38 |
| 3,283,425 | 11/1966 | Boyd | 86/45 |
| 3,636,812 | 1/1972 | Nuler | 86/24 |
| 3,748,950 | 7/1973 | Huntington | 86/24 |
| 3,973,465 | 8/1976 | Bachhuber et al. | 86/36 |
| 4,056,062 | 11/1977 | Walser et al. | 102/281 |
| 4,392,321 | 7/1983 | Bosworth | 42/87 |
| 4,632,008 | 12/1986 | Horner | 86/24 |
| 5,435,223 | 7/1995 | Blodgett et al. | 86/38 |

FOREIGN PATENT DOCUMENTS

| | | | |
|---|---|---|---|
| 2094479 | 2/1972 | France | 86/23 |

*Primary Examiner*—Harold J. Tudor
*Attorney, Agent, or Firm*—Klarquist Sparkman Campbell Leigh & Whinston, LLP

[57] ABSTRACT

A device and method for loading components into holders used in cartridge case reloading machinery is disclosed. The loading device includes a tray that receives and orients reloading components such as primers. The tray includes a strip receptacle which receives and positions a component holder while components are oriented by the tray and moved into position into receptacles in the component holder. The components are forced into the component holder by manual pressure, a roller, or a lever actuated bar. After the components are pressed into the component holder, the holder may be removed from the loading device and used in reloading machinery.

23 Claims, 8 Drawing Sheets

APPARATUS AND METHOD FOR LOADING ITEMS INTO COMPONENT HOLDER

BACKGROUND OF THE INVENTION

1. Field of the Invention

This invention pertains to items used for reloading ammunition and in particular pertains to an apparatus and method for loading components, such as primers, into a component holder.

2. Description of the Related Art

Many gun enthusiasts reload their ammunition to save money or to create custom ammunition. The basic reloading operation consists of retrieving a spent cartridge case, removing the used primer, resizing the cartridge case, and inserting a new primer, gun powder and bullet. Suppliers of reloading equipment constantly seek to make the operation more efficient, reliable and safe. A recent development in this regard is the use of component holders that receive and hold primers or bullets.

An exemplary component holder is a polymeric strip that can hold a plurality of primers. The strips can be fed into a reloading machine and positioned at an appropriate location so a primer may be dispensed from the strip into a cartridge case by the reloading machine. Such strips make it much easier to handle primers during reloading operation. Similar strips also may be used for providing bullets to reloading machines by providing the strip in an appropriate size.

While component holders may be preloaded with primers or bullets at a manufacturing facility it is sometimes desirable for the gun enthusiast to reload the strip with components of his or her own choosing. For example, manufacturers may provide primer holders with one or two primer types only and a gun enthusiast may wish to use other types of primers for a particular application.

It thus is desirable for the gun enthusiast to load loose primers into a reloading strip. Manually loading individual primers would be very tedious and time consuming. Accordingly, a device and method to assist in loading components into a reusable component holder is highly desirable. Currently, no such device or method appears to be available to assist in such an operation.

SUMMARY OF THE INVENTION

The present invention seeks to provide a device and method for loading cartridge components into a component holder. In a preferred embodiment of the invention, the device comprises a tray that receives a plurality of primers, orients them in upright positions and properly presents them to a primer holder, after which they are pressed into the holder. The primer holder then can be used with reloading machinery to supply primers for insertion into cartridge cases.

Preferably, the tray includes a strip receptacle for receiving the component holder strip such that it is substantially flush with an upper surface of the tray. The device includes a pivotally mounted lever that presses against a bar that seats the primers in the component holder. A pin strip having a plurality of pins and columns is spring biased so that the pins are urged into the strip receptacle to assist with orienting the strip and primers.

Alternative embodiments of the invention include a tray having a row of primer receptacles. A separate lid has orienting ribs for correctly orienting the primers. In this embodiment the primers are oriented in the lid and the tray is placed over the lid and the combination is inverted so the primers rest on the tray. The primers are then moved into the primer receptacles and the component holder is pressed down over the primers. To fully seat the primers, the holder with primers is removed from the tray and placed on a smooth surface and the primers are pressed into the holder. The tray may be double sided to provide receptacles of a different size on different sides of the tray.

Another embodiment is a tray having orienting ribs along a primer receiving surface and a strip receptacle for receiving a component holder. After being correctly oriented by the ribs, the primers are pushed partially into openings in the component holders. The component holder is then slid along the strip receptacle through a reducing portion that wedges the primers firmly into the component holder. This embodiment may be provided with dual reducing portions at opposite ends of the strip receptacle to accommodate different sizes of component holders or primers.

In yet another embodiment, the reloading device comprises a tray having a strip receptacle for receiving the component holder. The tray may also include ribs for orienting primers in the tray. After the primers are manually slid into the component holder a roller or compression bar may be used to seat the primers in the holder.

Various advantages and features of novelty which characterize the invention are particularized in the claims forming a part hereof. However, for a better understanding of the invention and its advantages, reference should be had to the drawings and to the accompanying description in which there is illustrated and described a preferred embodiment of the invention.

DETAILED DESCRIPTION OF THE PREFERRED EMBODIMENTS

The invention described herein is operable to receive a plurality of components (such as primers) for a reloading operation, orient those components and load them into a component holder. The holder then can be used in a reloading machine for supplying and positioning the components for insertion into cartridge cases.

Figure 1:
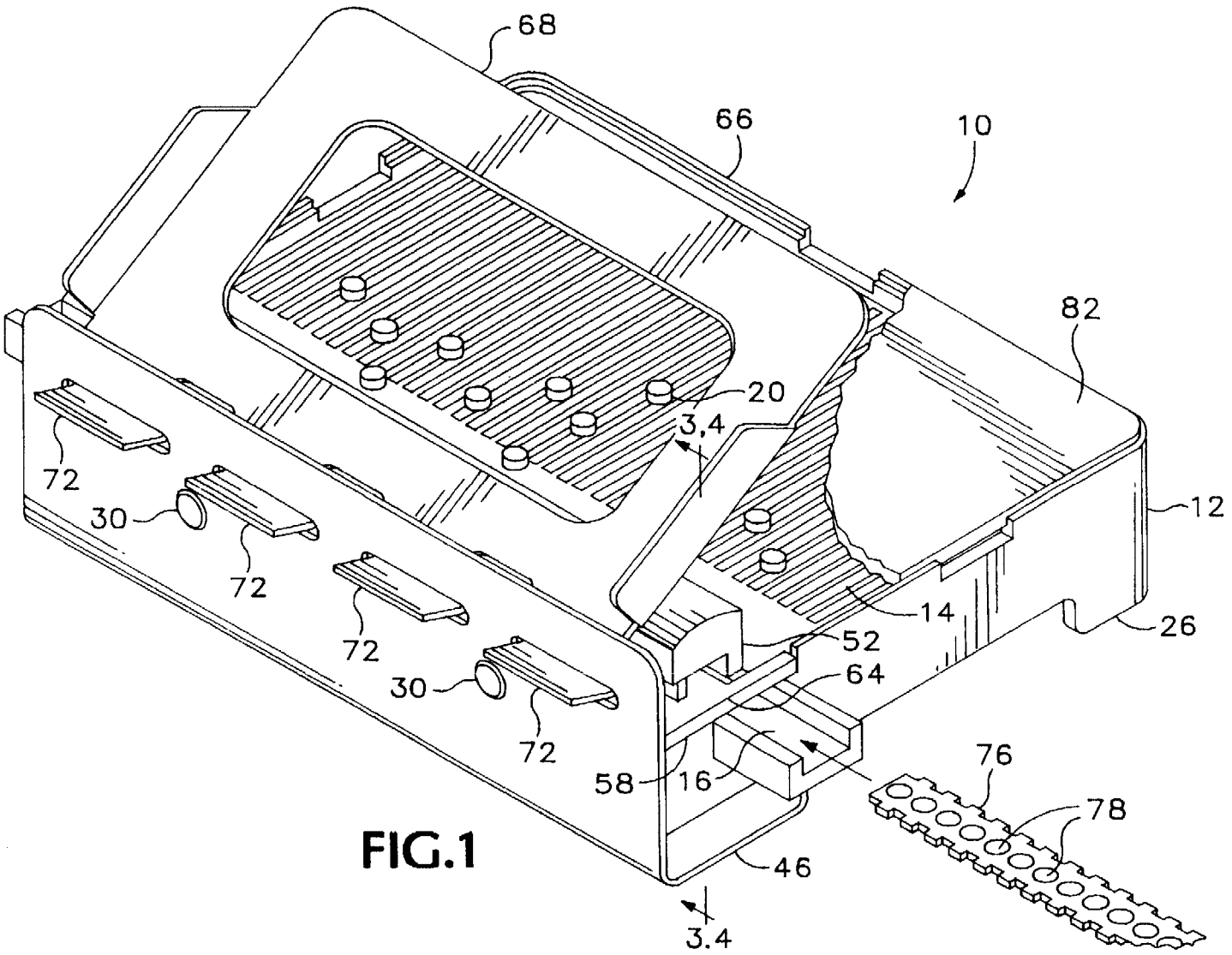
FIG. 1 is a perspective view of a first embodiment of a loading device of the present invention showing a component holder ready to enter a strip receptacle.
Figure 2:
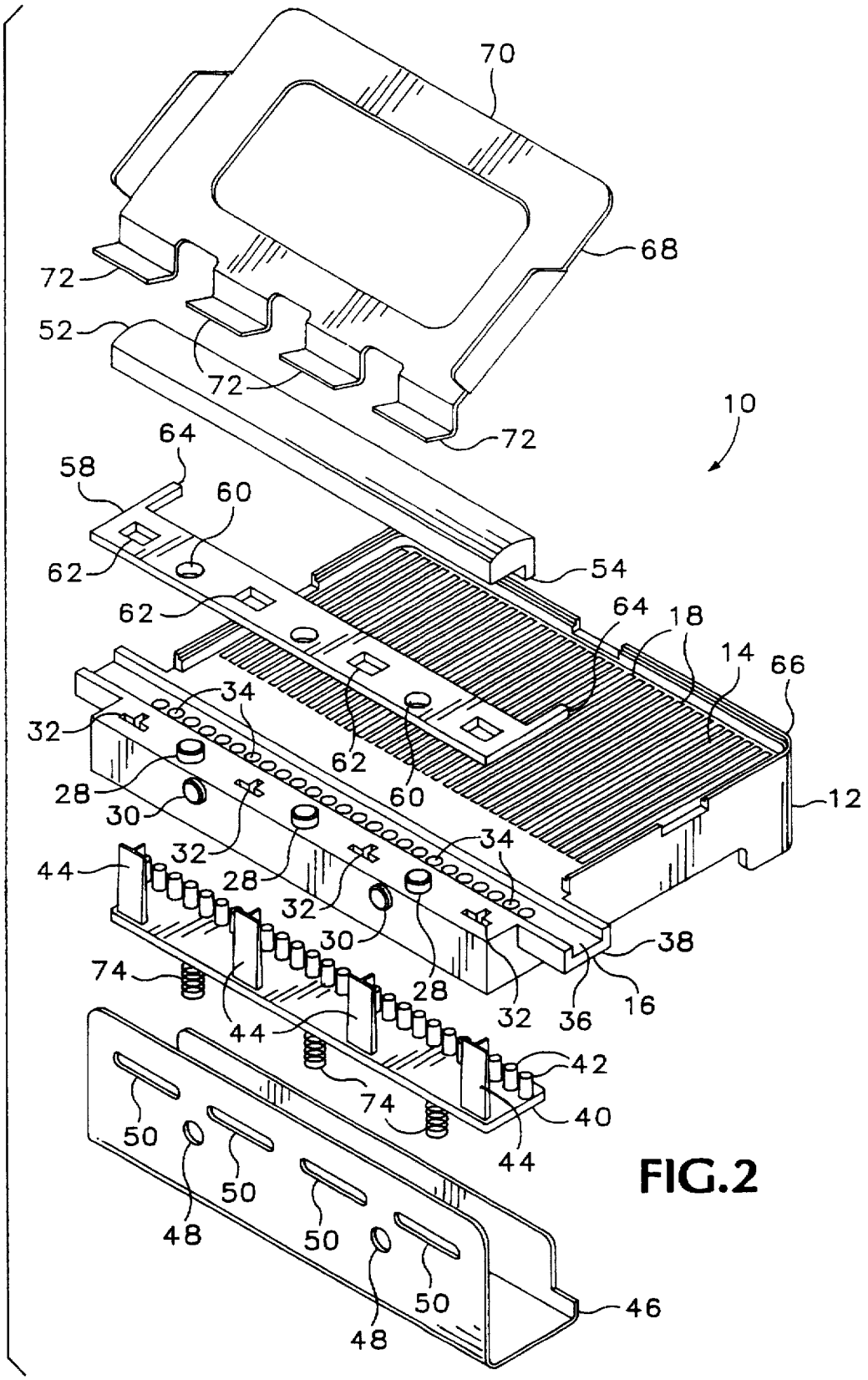
FIG. 2 is an exploded view of the device shown in FIG. 1.

In FIGS. 1 and 2 there is shown a loading device 10 according to a first embodiment of the present invention. Device 10 includes a tray 12 having an upper component receiving surface 14 and an elongate strip receptacle 16. In the embodiment shown, the component receiving surface 14 includes a plurality of elongate, substantially parallel friction ribs 18 (FIG. 2) extending substantially normal to strip receptacle 16. These ribs assist in orienting components loaded onto the component receiving surface 14.

Figure 3:
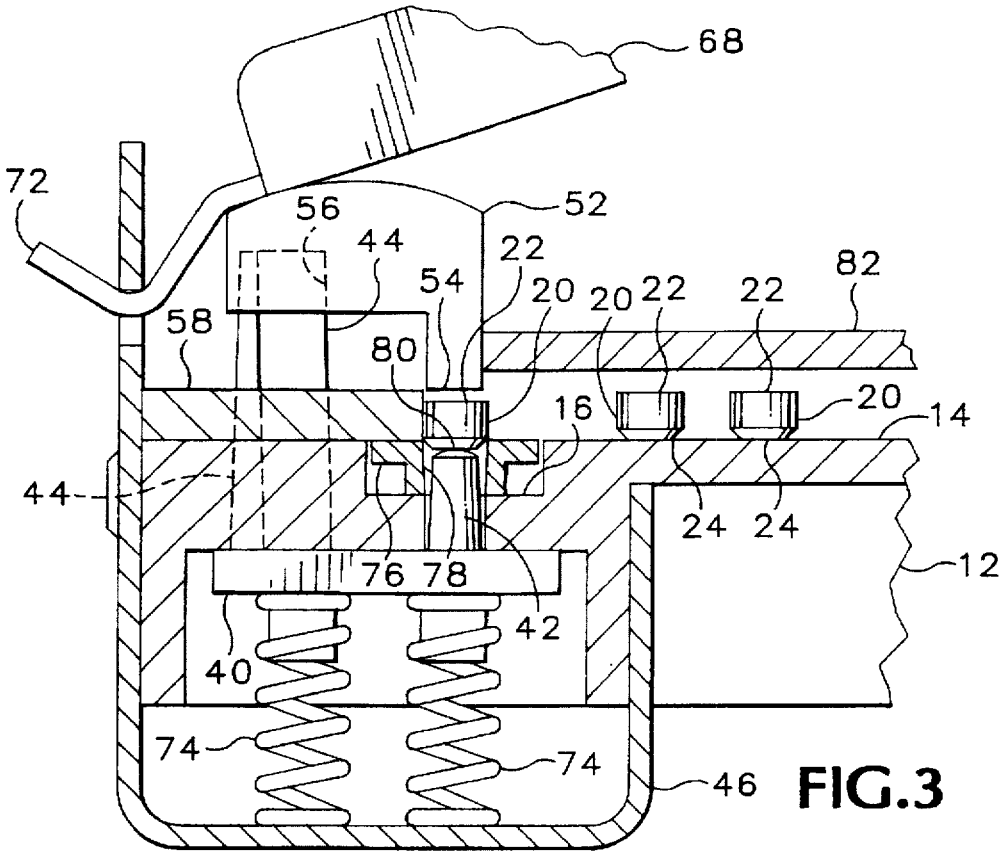
FIG. 3 is an enlarged cross-sectional view taken generally along the line 3—3 in FIG. 1 showing the lever in a nonactuated position.

Primers 20 have a flat anvil side 22 with relatively sharp outer edges, or corners, and an opposite side 24 with rounded or sloping outer edges, or corners (see the enlarged view of FIG. 3). It is desirable to have all the primers identically oriented (e.g., anvil side 22 up). Ribs 18 assist in orienting the primers in the manner explained below.

The tray 12 includes supporting feet 26 for supporting and elevating a portion of the tray. The tray also includes protrusions 28 and 30 for connecting to other parts of the loading device 10. Several substantially T-shaped openings 32 are provided, which allow cooperation between various parts of the loading device 10.

The strip receptacle 16 includes a plurality of arranged openings 34 that extend from an upper surface 36 to a lower surface 38 of the receptacle.

An elongate pin strip 40 includes a plurality of aligned slightly tapered upstanding pins 42 and substantially T-shaped columns 44. The columns 44 extend slidably through apertures 32 and pins 42 extend into openings 34.

The loading device 10 also includes a base member 46 which, in conjunction with the feet 26, supports the tray 12. Holes 48 in the base are sized and positioned to receive protrusions 30. Protrusions 30 may have grips to retain the base 46. Alternatively, the protrusions 30 may be plastic to allow staking so as to rivet the base 46 to the tray 12. The base 46 also includes several aligned slot openings 50.

An elongate seater bar 52 disposed above the tray and strip receptacle includes a pressure portion 54 and several slot receptacles 56 in the underside thereof. The slot receptacles are configured to receive the upper end of pin strip columns 44.

An elongate plate 58 includes round holes 60 and square openings 62. The holes 60 receive the protrusions 28 for connecting the plate 58 to the tray 12 similarly to the connection of base 46 to the tray 12. Plate 58 also includes arms 64 that act as a continuation of an upstanding tray rail 66 that corrals components on the component receiving surface 14. Openings 62 permit T-shaped columns 44 to pass through the plate. The pin strip 40 is located substantially within the base 46 and is biased toward the tray 12 by springs, or biasing members, 74 so that pins 42 extend slidably through the strip receptacle openings 34. Columns 44 extend through the tray apertures 32 and plate opening 62 and into the slotted receptacles 56 on the underside of the seater bar 52. Accordingly, the seater bar 52 and pin strip 40 are coupled together and move together. The forces of the biasing members 74 which urge the pin strip upward, toward the tray 12, also urge the seater bar 52 upward. (Directions are referenced to the embodiments as shown in the figures.)

A lever 68, having a handle portion 70, engages the base 46 by engagement tabs 72 which are received within the slotted openings 50. The lever presses against the top of the seater bar 52, but is free to pivot. Because the seater bar is biased upward it holds the lever 68 upward as illustrated in FIGS. 1 and 3.

The operation of the strip loading device 10 will now be explained with reference to FIGS. 1–4. The device 10 is used to load components, such as primers, into a component holder 76 which includes a plurality of aligned component-receiving receptacles, or openings, 78.

When no external forces operate on the loading device 10, the biasing members 74 push against the base 46 and urge the pin strip 40 and seater bar 52 upward. The lever 68 likewise is biased upward by its contact with the seater bar 52. In this position the pins 42 extend through the openings 34 and the tops 80 of the pins 42 are somewhat below the component receiving surface 14.

Pressing the lever 68 downward moves the pins 42 downward out of strip receptacle 16 so that a component holder 76 may be slid into the receptacle and aligned with the tray 12. Thereafter, lever 68 is released and pins 42 move upward into the receptacles 78 so that their tops again assume a position somewhat below the component receiving surface 14. An upper surface of the component holder 76 is substantially flush with the component receiving surface 14.

A plurality of primers 20 then are spilled onto the component receiving surface 14 and assume random orientations. The tray 12 may then be gently rocked end-to-end so that primers 20 which have their anvil side 22 down trip on the ribs 18 and flip over onto their rounded side 24. A lid 82 is placed over the tray 12 to cover the component receiving surface 14 to prevent spilling of primers 20. Preferably, the lid 82 is clear so that the primers may be viewed through the lid 82 and it must be close enough to surface 14 to prevent the primers from turning over.

Thereafter, the tray is tipped downwardly in the direction of strip receptacle 16 so that the primers work their way along the component receiving surface 14 toward the strip receptacle 16 until primers abut plate 58 as shown in FIG. 3. The primers 20 along the plate 58 form a row of primers positioned on top of the holder receptacles 78 and below the seater bar 52. The columns 44 are properly sized so that the distance between the tops 80 of the pins 42 and the underside of pressure portion 54 of the seater bar 52 is greater than the height of the components being loaded into strip 76.

The tray is then tilted back so that the strip receptacle 16 is oriented upward and primers which have not partially seated themselves in the holder receptacles 78 slide backward out of the way of the seater bar 52.

Figure 4:
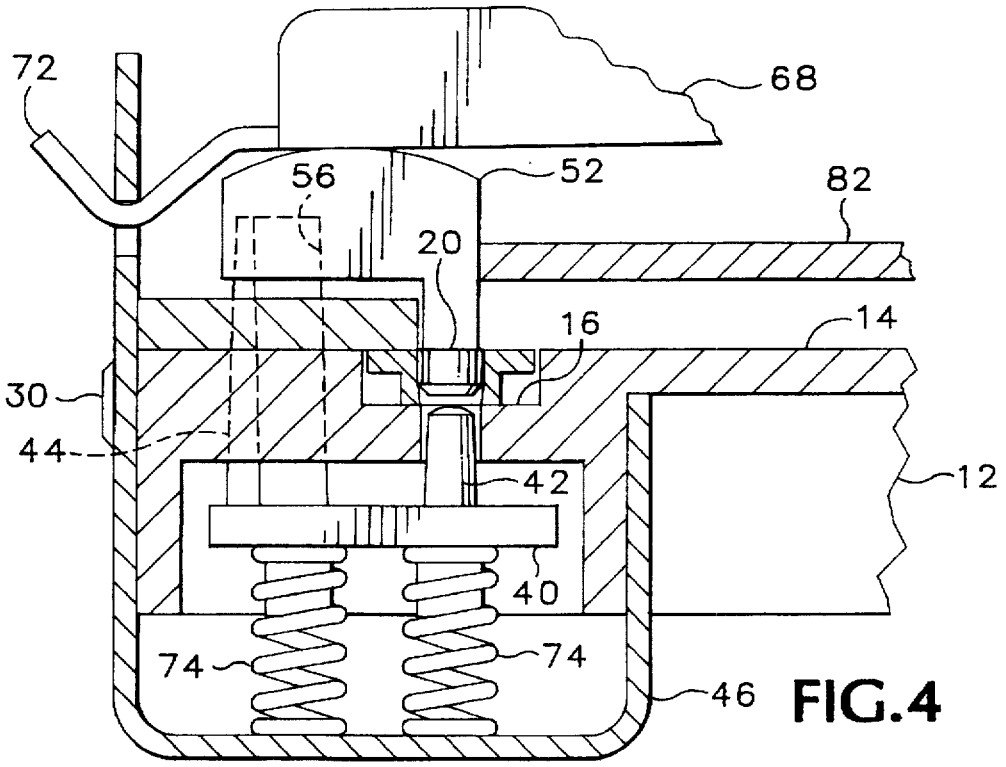
FIG. 4 is the cross section similar to FIG. 3 showing the lever in an actuated position.

The pins 42 assist in maintaining proper alignment of the components prior to and during their being pressed into the holder 76 so that they do not go in crooked or become jammed. When the components, such as primers 20, are in proper position as shown in FIG. 3, the lever 68 may be pressed downward thus moving the seater bar 52 downwardly to press the primers 20 into the holder 76. As the seater bar 52 moves downward, the pins 42 simultaneously move downward, retreating from the holder receptacles 78, as shown in FIG. 4. After the primers 20 are seated in the holder, frictional interference between the primers and the receptacles 78 prevent the spring-biased pin strip from pushing the primers out of the holder even after the lever 68 is released.

The preferred embodiment illustrates the biasing members 74 as six helical compression springs (two rows of three) pushing against the base 46 and the pin strip 40. Alternative designs of biasing members are available such as leaf springs, rubber bands, or other resilient devices. Additionally, the biasing members could be located in different places. For example, the biasing member 74 could be located about column 44 between the seater bar 52 and the plate 58. Additionally, the lever 68 could be pivotally connected directly to the tray 12 or pivoted to the base 46 by alternate methods.

Figure 5:
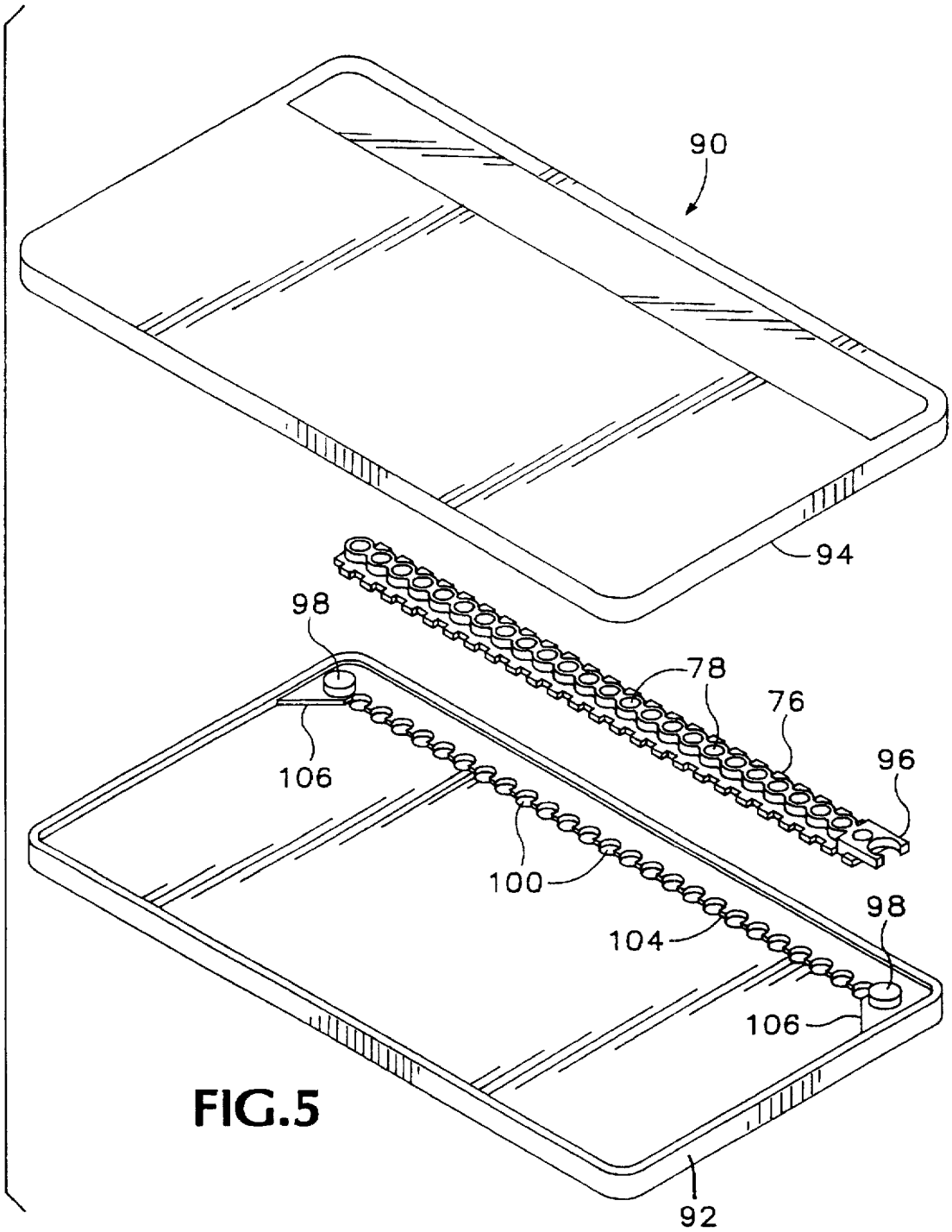
FIG. 5 is an exploded view of a second embodiment of a loading device of the present invention.

A second embodiment of a reloading device is shown as device 90 in FIG. 5. Device 90 includes a tray 92 and a lid 94. Also shown in FIG. 5 is component holder 76 having the component receptacles 78. In this view, it can be seen that the component holder 76 includes an engaging portion 96. Normally, the purpose of the engaging portion is to engage another component holder 76 for continuous operation in reloading equipment. However, the tray 92 of this embodiment makes use of the engaging portion to assist in aligning the component holder 76.

Figure 8:
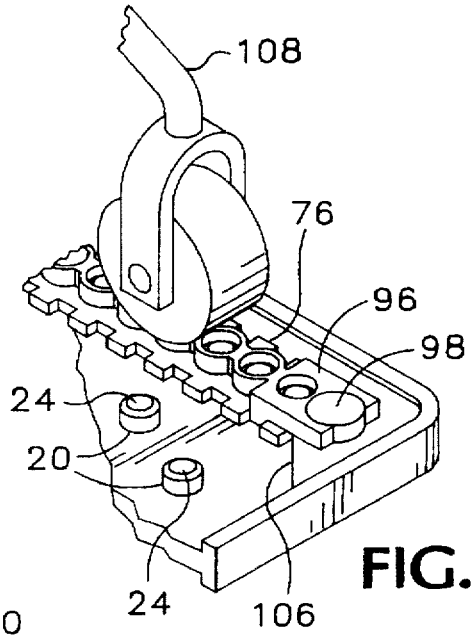
FIG. 8 is a partial perspective view of a portion of the second embodiment also showing a component holder mounted on the loading device and a roller pressing down upon the component holder.
Figure 6:
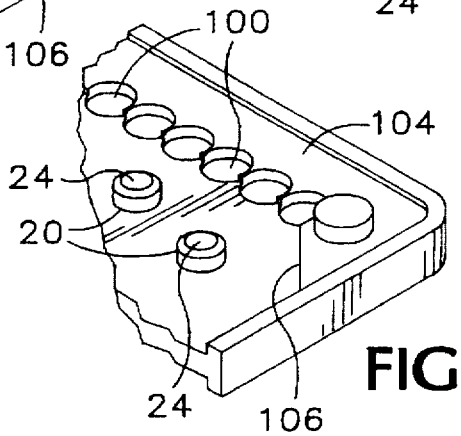
FIG. 6 is a partial perspective view of a portion of the second embodiment.
Figure 9:
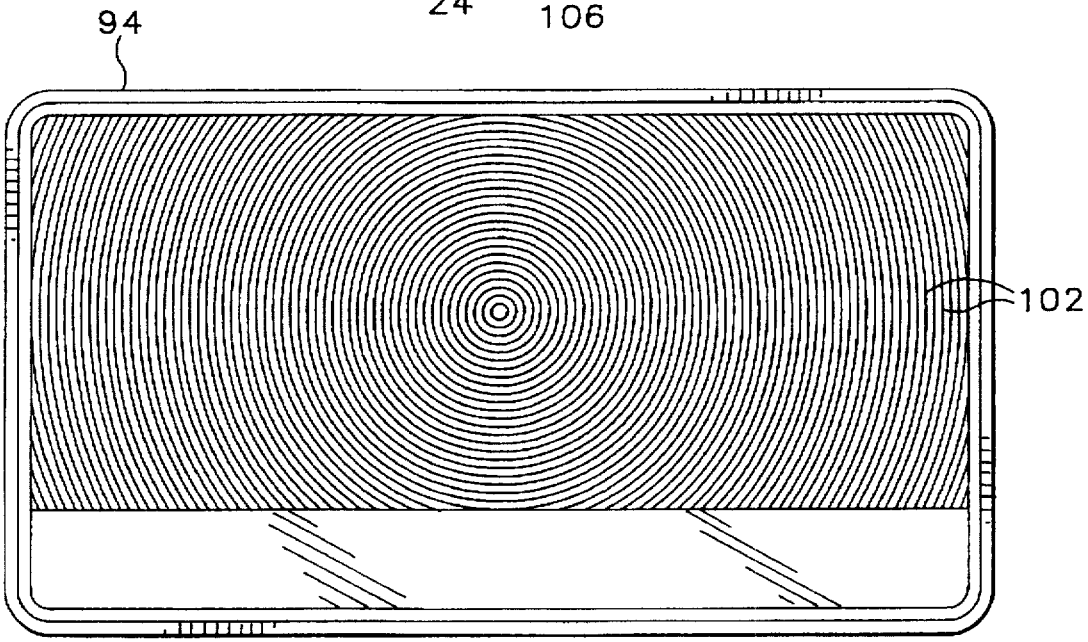
FIG. 9 is a plan view of a lid associated with the loading device of the second embodiment.

As can be seen, the tray 92 includes engaging pins 98 for coupling to the engaging portion 96 on the component holder 76. Also, the tray 92 includes component receptacles 100 arranged in a pattern identical to the component receptacles 78 of the component holder 76. The tray component receptacles 100 are sized to loosely receive reloading components such as primers 20 (see FIGS. 6–8). With reference to FIG. 9, it can be seen that the lid 94 includes a plurality of ribs 102 for orienting the primers 20. In a variation of the embodiment, the tray 92 is provided with component receptacles 100 on each side of the tray. The receptacles 100 on the different sides may be differently sized to accept and position different sizes of primers.

The tray 92 also includes a scalloped fence 104 that partially surrounds each of the receptacles 100. The fence 104 also includes beveled distal ends 106 for guiding the primers toward the receptacles 100. The purpose of the fence 104 is to separate and position the primers into the receptacles 100.

The loading device 90 performs its function as follows. The lid 94 and tray 92 are separated and the lid 94 is oriented with the ribs 102 upward. A number of primers 20 are spilled onto the lid 94 and the lid is rocked back and forth until the primers 20 are all oriented properly. Preferably, the number of primers equals or is greater than the number of tray receptacles 100. Recalling the description of orienting the primers above, it will be recalled that the ribs 102 will trip those primers 20 with their anvil side down so that the primers end up with their rounded side down. Thereafter, the tray 92 is inserted on top of the lid 94 and the combined lid and tray are turned over so that the primers are located on the tray 92. As with all embodiments, the tray 92 and lid 94 are sized and arranged so that the primers 20 cannot flip over when the lid 94 is engaged to the tray 92.

Figure 7:
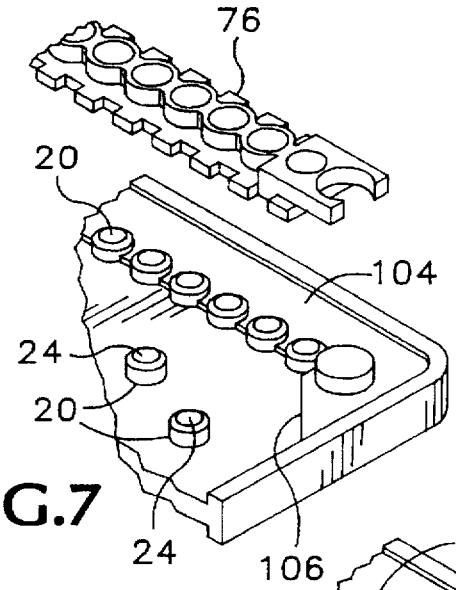
FIG. 7 is a partial perspective view of the second embodiment also showing a component holder raised above the loading device.

After the tray 92 is oriented below the lid 94, the lid may be removed and all the primers 20 are now oriented with their rounded side 24 upward. The tray is then gently rocked back and forth and tilted so that the primers 20 travel toward the tray receptacles 100 and fall into the receptacles. The fence 104 assists in separating and positioning the primers 20. Thereafter, as shown in FIGS. 7 and 8, the component holder 76 may be lowered onto the primers 20. The engaging portion 96 couples with an engaging pin 98 to assist in aligning the component holder 76. A wheeled roller 108 or flat compression bar (not shown) may be used to press the component holder 76 down onto the primers 20. Thereafter, it may be necessary to remove the component holder 76 with embedded primers 20, from the tray 92 and set it on a smooth surface and again press it downward manually or with the roller 108 (or bar) to fully seat the primers 20 in the component holder 76.

Figure 10:
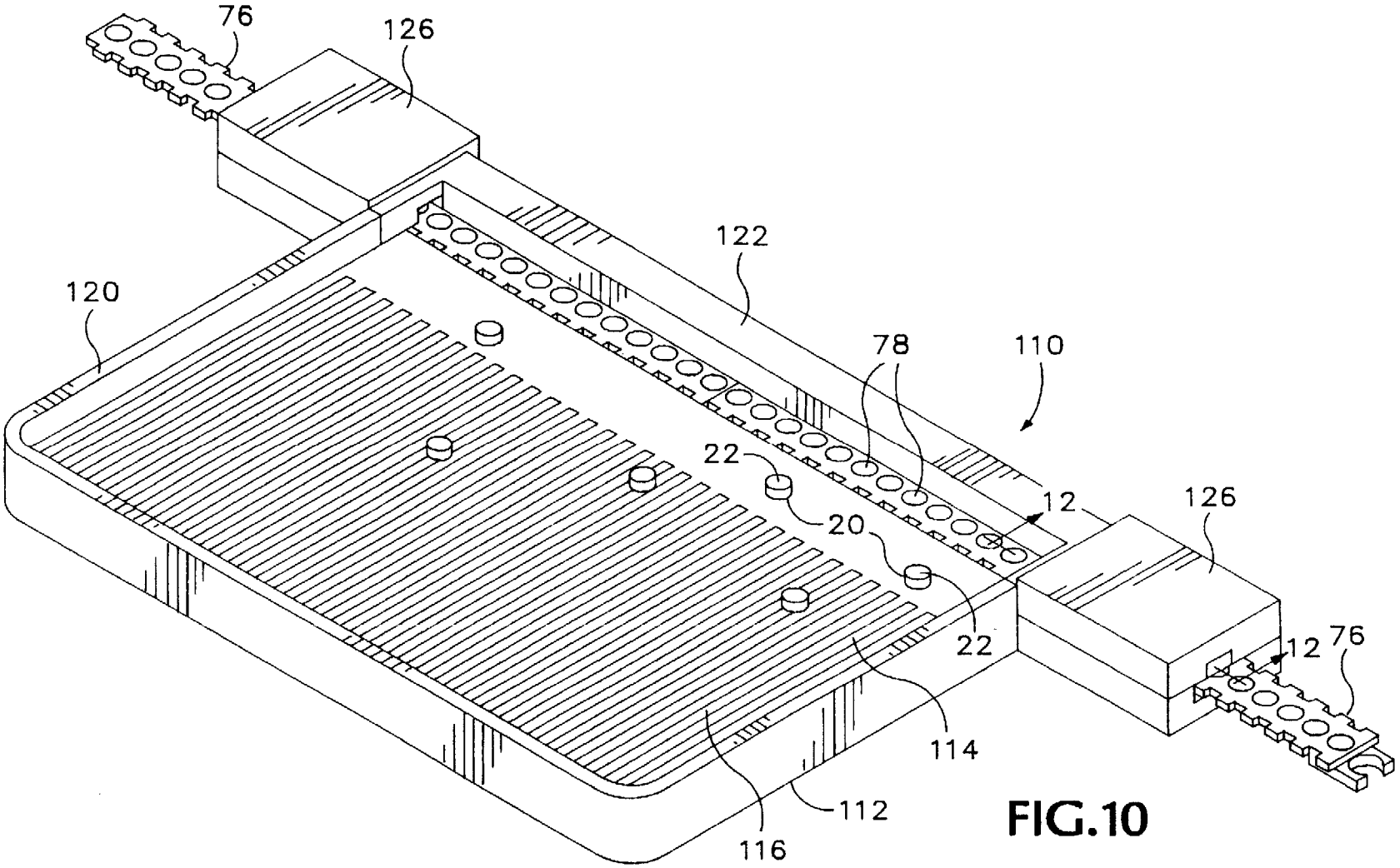
FIG. 10 is a perspective view of a third embodiment of a loading device of the present invention also showing component holders engaged with the loading device and components resting on an upper surface of the loading device.
Figure 11:
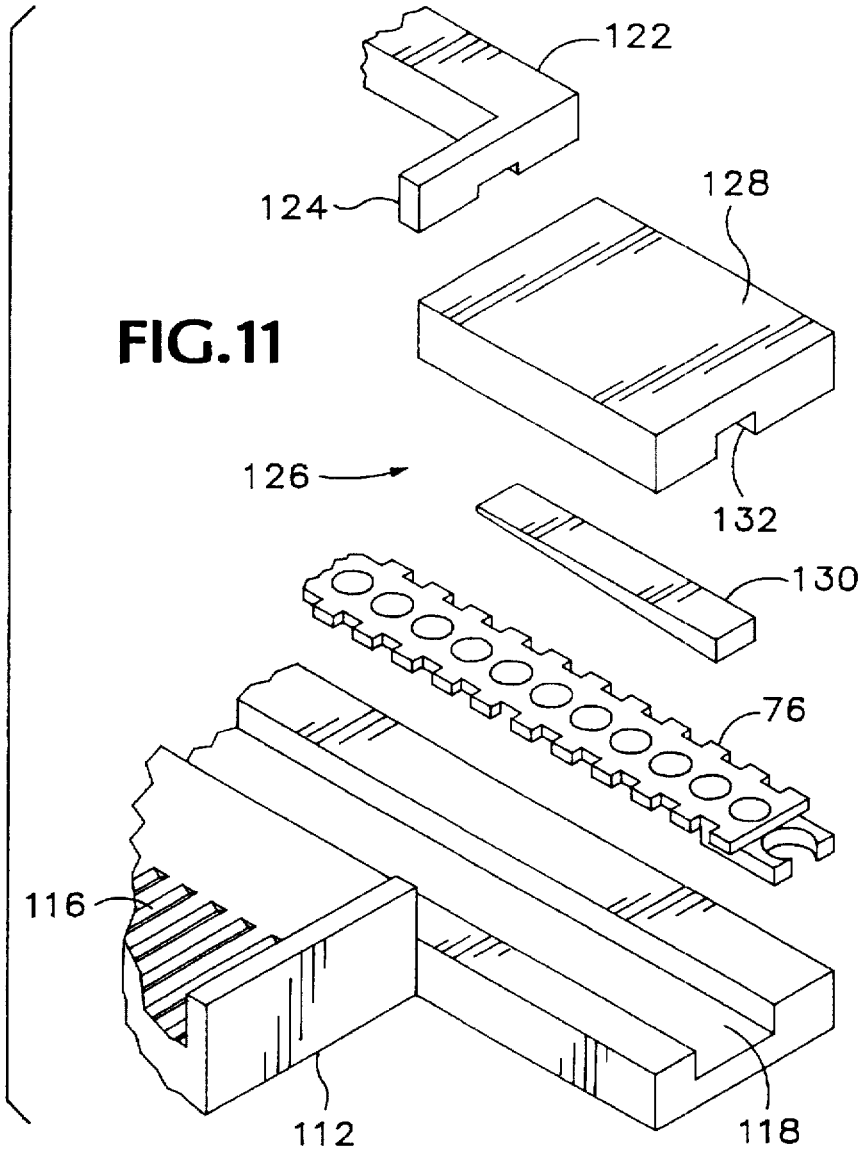
FIG. 11 is an exploded view of a constrictor associated with the loading device of the third embodiment and also showing a portion of a tray of the loading device.

A third embodiment of a component holder loading device is shown in FIG. 10 as device 110. This embodiment includes a tray 112 that has a component receiving surface 114 with a plurality of ribs 116 for orienting the primers 20. The tray 112 also includes a strip receptacle 118, best seen in FIG. 11, sized to receive component holders 76. The tray 112 also includes a perimeter rail 120 and a removable fence 122. The fence 122 includes distal arms 124 that bridge the strip receptacle 118. The device 110 also includes at least one ramp constrictor 126 located at an end of the strip receptacle and aligned therewith. As best seen in the exploded view of FIG. 11 and the cross section of FIG. 12, the ramp constrictor 126 includes a cap 128 and a beveled ramp 130. The ramp 130 fits into a channel 132 in the cap 128. The cap 128 and ramp 130 are then affixed to the top of the tray over the strip receptacle 118. The purpose of the ramp constrictor 126 is to force primers 20 into the component holder 76 in a quick and easy manner.

Figure 12:
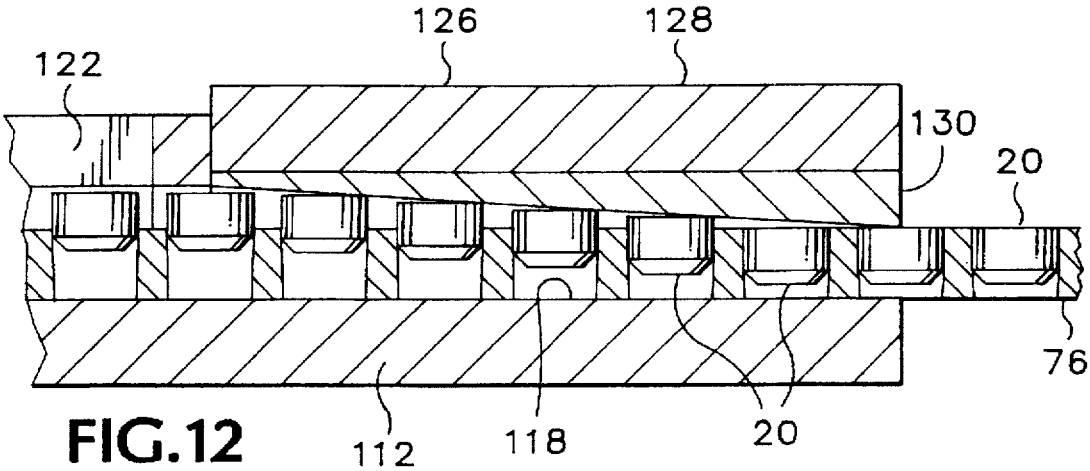
FIG. 12 is a cross section view of a ramp constrictor associated with the loading device of the third embodiment.

As with previous embodiments, components, such as primers 20, are spilled onto the tray 112 and oriented by the ribs 116 so that their flat, anvil side 22 is oriented upward. Thereafter, the primers 20 may be manually pushed onto a component holder 76 located in the strip receptacle 118. After the primers 20 are loosely nested in the holder receptacles 78 the component holder 76 is slid along the strip receptacle 118 through the ramp constrictor 126 as best seen in FIG. 12. As the holder 76 passes through the constrictor the ramp 130 forces the primers 20 into the holder 76.

Figure 13:
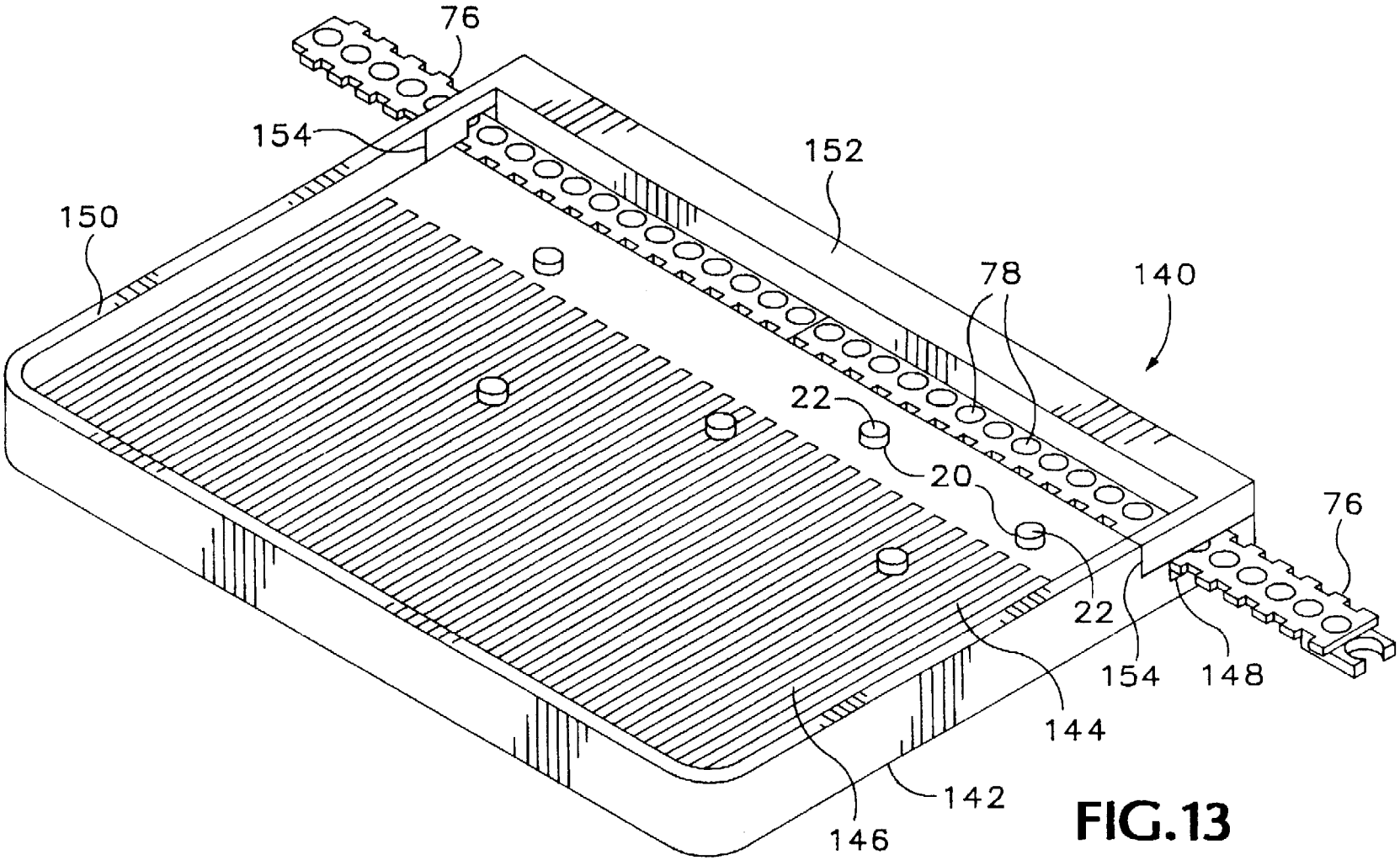
FIG. 13 is a perspective view of a fourth embodiment of a loading device of the present invention.

Another embodiment of a component loading device is shown in FIG. 13 where device 140 includes a tray 142. The tray includes a component receiving surface 144 having a plurality of ribs 146. The tray 142 also includes a strip receptacle 148 for slidingly receiving a component holder 76. The tray includes a rail 150 that extends around the component receiving surface 144 for containing components such as primers 20 on the surface 144. Beyond the strip receptacle 148 a fence 152 acts to prevent components 20 from falling off of the tray 142. The fence 152 includes distal arms 154 that are arranged contiguous with portions of the rail 150. In this embodiment, components are simply placed on the surface 144 and oriented by the ribs 146 as described above. Thereafter, the components 20 are manually guided and pushed into the primer receptacles 78 in the component holder 76. A roller, such as roller 108 shown in FIG. 8, or a flat compression bar (not shown) may also be employed to fully press the components 20 into their respective receptacles 78.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

We claim:

1. Apparatus for loading items into a component holder strip having openings for receiving such items, comprising:

(a) a tray, (b) a lever pivotally coupled to the tray, (c) a strip receptacle having a plurality of openings and configured to receive and hold such strip, (d) a seating bar having a portion oriented toward the receptacle;

(e) a biasing member coupled to the seating bar to bias the seating bar away from the strip receptacle, and wherein actuation of the lever moves the seating bar toward the strip receptacle such that items properly oriented adjacent a component holder strip located in the strip receptacle are pressed into the holder strip by the seating bar, and (f) a pin strip having a plurality of pins thereon, the pin strip being positioned adjacent the openings and biased by the biasing member such that the pins extend into the openings.

2. The apparatus of claim 1 which further comprises a column operatively connecting the pin strip and seating bar.

3. The apparatus of claim 1 which further comprises a base coupled to the tray proximate the openings, the base including a plurality of lever receiving apertures, and the lever being hingedly coupled to the base at the lever receiving apertures.

4. The apparatus of claim 1 which further comprises a column extending between and operatively connecting the pin strip and seating bar, and a base coupled to the tray proximate the openings, the lever is hingedly coupled to the base, the tray is operable to accept items to be loaded into a holder strip held in the strip receptacle and the lever is operable to move the seating bar which acts upon properly positioned items to load the items into the holder strip.

5. The apparatus of claim 1 which further comprises columns which are coupled to the seating bar and the pin strip so that the seating bar and pin strip move together and wherein the tray accepts items to be loaded into the holder strip and the lever is operable to move the seating bar which acts upon properly positioned items to load the items into the holder strip.

6. A component loader for loading cartridge reloading components into a component holder, comprising:

(a) a tray having a strip receptacle for receiving the component holder, the strip receptacle including a plurality of openings positioned according to an opening arrangement;

(b) a pin strip having a plurality of pins positioned adjacent the openings and the pins being positioned according to the opening arrangement;

(c) a biasing member coupled to the pin strip urging the pin strip in a direction such that the pins are urged into the openings;

(d) a seating bar coupled to, and movable with, the pin strip; and (e) a lever pivotally coupled to the tray and coupled to the seating bar such that the biasing member urges the lever upward and an external force on the lever moves the seating bar downward so that items properly positioned on a component holder strip located in the strip receptacle are loaded into the holder strip.

7. The loader of claim 6 wherein at least one column extends through the tray and a portion of the tray is located between the pin strip and the seater bar.

8. The loader of claim 7 wherein the tray further includes at least one aperture and the column is slidably received within the aperture.

9. The loader of claim 6 wherein the tray has an upper item receiving surface and the pins are biased into the openings in the strip receptacle and ends of the pins are substantially flush with the surface of the tray when no external force is acting on the component loader.

10. The loader of claim 6 further comprising a component holder and wherein a surface of the holder is substantially flush with an item receiving surface of the tray and the holder includes a plurality of openings arranged according to the opening arrangement.

11. The loader of claim 6 wherein the tray includes a rail to contain items on the tray.

12. The loader of claim 6 wherein the tray includes a rail to contain items on the tray and further comprises a lid that couples to the tray to maintain the orientation of the components.

13. The loader of claim 6 wherein the tray includes a rail and further comprising a substantially transparent lid that couples to the tray wherein the lid and rail cooperate to contain items on the tray.

14. The loader of claim 6 further comprising a base coupled to the tray which cooperates with the biasing member to bias the pin strip.

15. The loader of claim 6 wherein the tray includes an item receiving surface comprised of orienting ribs.

16. A method of loading components into component holding openings in a component holder for use with a cartridge reloading apparatus; comprising the steps of:

(a) actuating a lever to move a pin strip having a plurality of pins out of respective plurality of openings in a strip receptacle and inserting the component holder into the strip receptacle and deactuating the lever;

(b) locating components on a tray having the component holder located thereon;

(c) orienting the components in desired positions relative to the component holding openings; and (d) pressing the components into the component holding openings.

17. The method of claim 16 further comprising the step of moving the tray to orient the components in a selected position on the tray.

18. The method of claim 16 further comprising the step of moving the tray to orient the components over the component holding openings.

19. The method of claim 16 further comprising the steps of actuating said lever to press on a seating bar to press on the components to load the components into the holder.

20. The method of claim 16 wherein the step of actuating said lever comprises moving the lever toward the tray.

21. The method of claim 16 further comprising the step of actuating said lever to press on a seating bar that is coupled to said pin strip.

22. The method of claim 16 wherein the step of actuating said lever presses on a seating bar that is coupled to said pin strip positioned adjacent the openings, such that the actuation moves the seating bar and simultaneously moves the pin strip so that the pins on the pin strip retreat from the openings in the strip receptacle on the tray as the seating bar moves toward the strip receptacle.

23. The method of claim 16 further comprising the steps of moving the tray to upright the components and moving the tray to orient the components on the holder, and actuating the lever to press on a seating bar that is coupled to the pin strip positioned adjacent the openings having said plurality of pins extending into openings in the strip receptacle so that the seating bar and the pin strip move simultaneously and the seating bar presses the components into the holder as the pins retreat from the openings.

* * * * *